United States Patent [19]

Peyman

[11] Patent Number: 4,856,448

[45] Date of Patent: Aug. 15, 1989

[54] HARMONICA SAIL

[76] Inventor: R. Allan Peyman, P.O. Box 36, East Alton, Ill.

[21] Appl. No.: 179,742

[22] Filed: Apr. 11, 1988

[51] Int. Cl.[4] ..... B63H 9/06

[52] U.S. Cl. ..... 114/103

[58] Field of Search ..... 114/39.1, 39.2, 102, 114/103

[56] References Cited

U.S. PATENT DOCUMENTS

| | | | |
|---|---|---|---|
| 2,569,318 | 9/1951 | Kersten | 114/103 |
| 3,053,219 | 9/1962 | Coon | 114/103 |
| 3,298,346 | 1/1967 | Cochran | 114/103 |
| 3,403,653 | 10/1968 | Bush | 114/103 |
| 4,006,701 | 2/1977 | Corbellini | 114/102 |
| 4,122,792 | 10/1978 | Rhoades et al. | 114/103 |
| 4,558,655 | 12/1985 | Debarge | 114/39 |
| 4,624,203 | 11/1986 | Ferguson | 114/39 |
| 4,677,928 | 7/1987 | Hoyt | 114/39 |
| 4,685,410 | 8/1987 | Fuller | 114/102 |

OTHER PUBLICATIONS

Bob Ross, "Unfurling the Secret Sail", *Sail Magazine,* 9/87, pp. 79, 80, 82.

*Primary Examiner*—Sherman D. Basinger

*Attorney, Agent, or Firm*—Senniger, Powers, Leavitt & Roedel

[57] ABSTRACT

A sail for a boat comprising a first panel having a predetermined draft therein, a second panel having a predetermined draft therein, and a plurality of baffles extending between the first and second panels, the first and second panels being open at the luff an leech edges to allow wind to pass therebetween so that the first and second panels can assume their respective predetermined draft shapes. The baffles preferably comprise a plurality of elevationally spaced, generally horizontal webs extending substantially from the luff edges to the leech edges of the panels. These webs are preferably cambered longitudinally in the luff to leach direction, with the leech end of each web elevationally higher than the luff end of the web.

17 Claims, 2 Drawing Sheets

HARMONICA SAIL

BACKGROUND OF THE INVENTION

This invention relates to sails, and in particular to a double panel sail.

Conventional sails, like those still in use today, typically comprise a fabric panel which is constructed with a particular draft—or depth and curvature—so that when properly trimmed it assumes a curved shape with a convex leeward side and a concave windward side. The velocity of the air on the convex leeward side of the sail is generally greater than the velocity of the air on the concave windward side of the sail. Since pressure generally decreases as the velocity increases, the pressure is relatively lower on the leeward side of the sail than on the windward side of the sail. In addition, the wind acts on the windward side of the sail to produce a force on the windward side of the sail. The resulting strong relative negative pressure (or suction) on the leeward side of the sail and the moderate positive force on the windward side of the sail produces a thrust on the mast that propels the sail boat.

The total driving force on the sail boat is a function of the total sail area. Thus sails are sized and shaped to maximize sail area, and the boat and rigging are designed to permit the use of various types of sails such as stay sails, jibs, and other filler sails. The height of the sails must be limited to prevent excessive heeling of the boat and to keep the mast size within practical limits. Similarly the breadth of the sails must be limited to keep the boom and the rigging within practical limits. The use of stay sails is also limited, particularly in smaller boats, due to the limitations of the rigging and the ability of the crew to handle the additional sails. Space is another limitation on the use of stay sails since it is common practice to have several suits of sails for the various wind conditions that may be encountered. The number of these stay sails is compounded by this practice, presenting a storage and handling problem, particularly on a small boat.

The draft of a sail is the source of sail power going windward. The draft is designed taking into account the stability of the hull, the intended use of the boat, and the anticipated wind and sea conditions. The design of the draft also takes into account maximizing boat speed while minimizing the pointing angle (the angle of the boat with respect to the apparent wind which determines how efficiently the boat can "beat" or sail into the wind). The shape of the curvature, including the position of the point of maximum curvature, and the depth of curvature (the camber ratio), are designed for the particular boat. Maintaining this designed draft for the sail is important to efficient sailing.

It is difficult to construct the designed sail shape because the sail materials are lightweight and flexible, and as a consequence tend to stretch. Stiffer, more stretch-resistant materials tend to have less tear resistance and are also more difficult to handle. A great deal of attention has been devoted to the mechanics of sail construction to minimize sail distortion. Careful selection of the material and the use of composites and multiply materials is one way of combating stretch. It is also known that cloth stretches differently in different directions, and thus selection of the weave and careful orientation of the material is another way of controlling sail stretch. Miter cut, radial cut, spider web cut, and star cut sail constructions are examples of attempts to minimize sail distortion by optimizing the orientation of the cloth in the sail. Finally there are various finishing processes that can reduce in-service distortion of the sail.

SUMMARY OF THE INVENTION

It is among the objects of the present invention to provide a sail that gives increased sail area for a given size. It is a further object of the present invention to provide such a sail that can be used on conventionally rigged boats, with minimum of modification. It is also among the objects of the present invention to provide a sail that is lightweight, flexible, and easy to handle, but which resists distortion from its designed draft shape; and to provide such a sail that is of simple and inexpensive construction.

Generally, the sail of the present invention comprises a first panel having a predetermined draft therein, a second panel having a predetermined draft therein, and a plurality of baffles between the first and second panels. The first and second panels are open at their respective luff and leech edges so that wind can pass between the first and second panels causing the panels to assume their designed draft configurations, with the spacers stabilizing each panel with respect to the other to minimize distortion from the predesigned draft. In the preferred embodiment the spacers are generally horizontal webs, extending substantially from luff to leach.

When the boat is headed windward, sufficient wind can pass outside and between the first and second panels to cause the panels to assume substantially their predetermined draft shaps. Thus the sail of the present invention provides two sail panels in the same space with the same rigging for a single panel, and without the handling problems of separate stay sails. Furthermore the baffles stabilize each panel with respect to the other, helping to prevent localized distortions of either panel, helping to maintain the designed shape of the panels and thereby maximizing the performance of the panels.

These and other advantages will be in part apparent and in part pointed out herein after.

BRIEF DESCRIPTION OF THE DRAWINGS

Corresponding references numerals indicate corresponding parts throughout the several views of the drawings.

DETAILED DESCRIPTION OF THE PREFERRED EMBODIMENT

Figure 1:
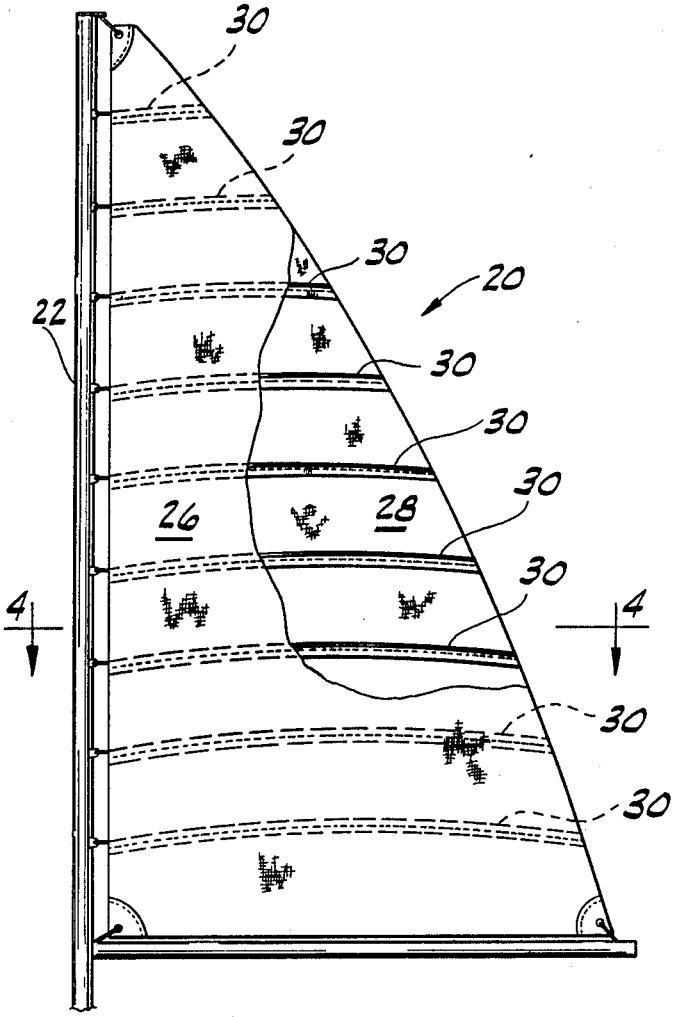
FIG. 1 is a side elevation view of a mainsail constructed according to the principles of this invention.
Figure 2:
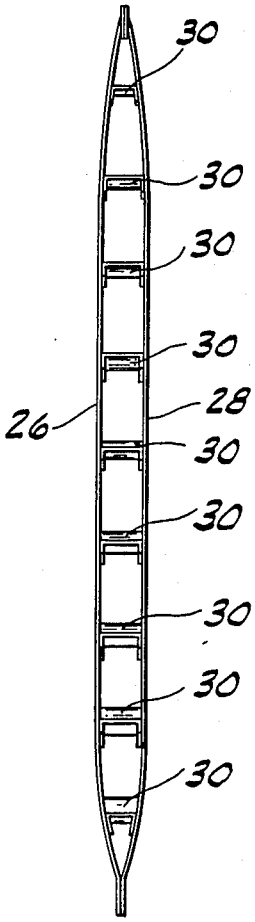
FIG. 2 is a rear or leech elevation view of the sail.
Figure 3:
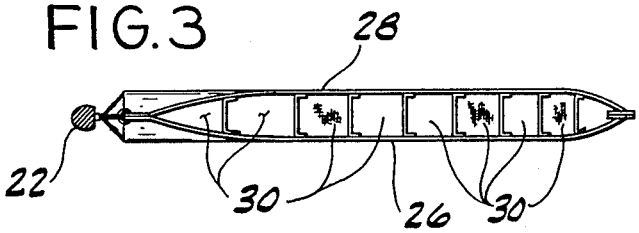
FIG. 3 is a top or head plan view of the sail.

A mainsail constructed according to the principles of this invention, indicated generally as 20, is shown in FIG. 1 in an unloaded condition as it might be mounted on the mast 22 and boom 24 of a boat (not shown).

Figure 5:
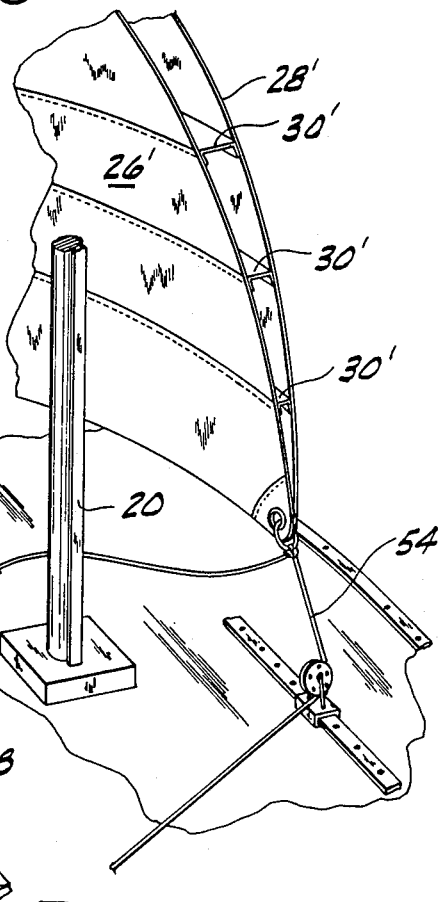
FIG. 5 is a partial perspective view of a jib sail constructed according to the principles of this invention, showing one method of securing the clew.
Figure 6:
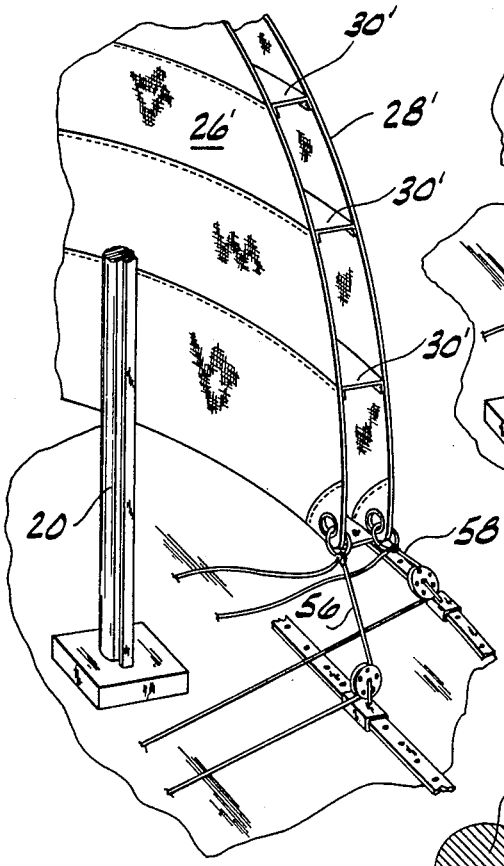
FIG. 6 is a partial perspective view of a jib sail constructed according to the principles of this invention, showing an alternate method of securing the clew.
Figure 7:
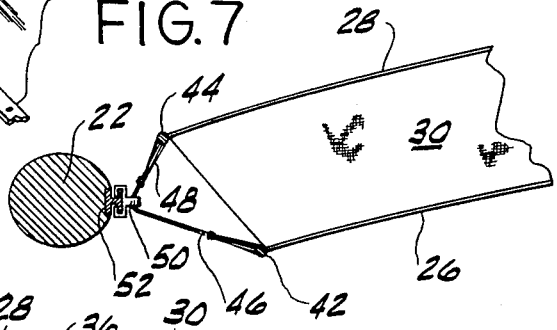
FIG. 7 is an enlarged view of a sail portion adjacent the mast.

Although FIGS. 1–4 show a mainsail, and FIGS. 5 and 6 show a jib sail, the sail construction of the present invention is not so limited, and could be applied to virtually any type of sail as would be apparent to a person of ordinary skill of the art.

The mainsail 20 comprises a first panel 26 having a predetermined draft constructed therein, and a second panel 28 also having a predetermined draft constructed therein. The drafts of the first and second panels 26 and 28 are not necessarily identical, although in the preferred embodiment the drafts are identical. The first and second panels 26 and 28 are arranged substantially parallel with each other. However, the first and second panels 26 and 28 are not necessarily the same size, and thus may not be co-extensive. A plurality of baffles extend between the panels 26 and 28. In the preferred embodiment, these baffles are a plurality of generally horizontal webs 30 extending substantially from the luff edges to the leech edges of the panels.

The inventor has discovered that under at least certain conditions it is desirable that the webs 30 have a slight camber in the longitudinal or luff-to-leech direction. It is also desirable that the leech ends of the baffles be slightly elevationally higher than the luff ends. The inventor has discovered that the cambering of the webs and the elevating of the leech end of the webs relative to the luff ends makes it easier to achieve air flow between the panels and fill the sail as more fully described below. The term "generally horizontal" as used to describe the webs 30 herein should therefore be understood to include such slight variations from horizontal.

The webs 30 each have first and second side edges secured to the first and second panels 26 and 28, respectively. The first edge of each web is preferably contoured to the shape of the first panel 26 along the line of their attachment. Similarly, the second edge of each web is preferably coutoured to the shape of the second panel 28 along the line of their attachment. In the preferred embodiment, when the webs are shaped the drafts of the two panels are considered to extend oppositely, so that the webs have a generally barrel shape, with convex side edges.

Figure 4:
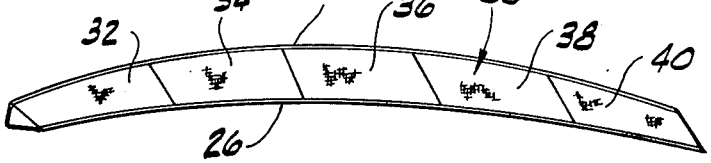
FIG. 4 is a cross sectional view of the sail taken along the plane of line 4—4 in FIG. 1, showing the sail under wind loading.

As will be readily understood by a person of ordinary skill in the art, even if the panels are formed with identical drafts, in use the shapes of the first and second panels 26 and 28 will be different because of the difference in wind loading between the panels. Generally the windward panel will have a flatter configuration than the leeward panel. Thus, as best shown in FIG. 4, the spacing between the panels, and thus the transverse dimension of each of the webs 30 is not constant from luff to leech. Generally, the distance between the panels will be the greatest in the area of maximum draft or maximum curvature of the panels, and the distance will be the smallest adjacent the luff and leech edges of the panels. This variable spacing can be accommodated by making the webs 30 wider in the area of maximum draft and narrower between the luff and leech edges of the panels, and thus have the general barrel shape described above.

The webs 30 are preferably made from a flexible material and thus have some degree of inherent stretchability. In the preferred embodiment the webs are constructed to be transversely stretchable, and preferably to have varying transverse stretchability. This varying transverse stretchability may be accomplished in a number of ways, including constructing the webs 30 from segments of different materials, or from segments of different weights or grades of the same material, or from segments of material with different orientations. The transverse stretchability of the webs 30 is preferably greatest between the points of maximum draft curvature of the panels and the transverse stretchability diminishes toward the luff and leech edges of the panels. In this preferred embodiment webs 30 comprise portions 32, 34, and 36, 38, and 40 located at the luff, luff-sent, center, center leech, and leech regions of the panels, respectively. For example, the luff and leech portions 32 and 40 might be made from a 3 ounce Dacron (tm) for minimal stretching, while the luff-center and the center leech portions 34 and 38 might be made of 2ounce Dacron (tm) for somewhat greater stretchability, and the center portion might be made from 1 ounce Dacron (tm) for the greatest stretchability to accommodate the greatest distances between the panels.

The webs 30 are sufficiently flexible to allow the relative shifting of the panels when the leeward panel becomes the windward panel and vice versa as the sail moves from one side of the boat to the other. Portions of the webs 30 may be stiffened, for example with battens.

The first and second panels 26 and 28 are open at their luff and leech edges to allow wind to pass through sail 20, between the panels 26 and 28, so that the panels 26 and 28 can fill with air. As noted above, even if the designed drafts of the first and second panels are identical, the actual shapes of the panels will not be identical because of differences in loading. As described above, the webs 30 preferably stretch to accommodate this difference in the shapes of the panels, while they stabilize each panel with respect to the other. The webs 30 thereby and help to support each panel relative to the other so that the panels maintain substantially their predetermined draft shapes, and thus sail 20 maintains its overall designed draft shape. It will be noted from FIG. 4 that the cross section of sail 20 is more like that of a rigid air foil or wing than a simple sail, and it is believed that this configuration improves performance in addition to stabilizing the draft shape of the sail.

In sailing in one direction the first panel 26 may be the leeward panel and the second panel 28 may be the windward panel. As the boat comes about, the panels change their relative positions so that the second panel 28 becomes the leeward panel and the first panel 26 becomes the windward panel. The webs 30 are sufficiently flexible to allow this change. Furthermore the webs are sufficiently stretchable to allow the difference in shape of the panels in the new orientation.

Because the first and second panels 26 and 28 alternate between being leeward and windward as the boat sails, the drafts of the two panels are preferably identical, so that boat performance can remain about the same in either mode of sailing. The design of the draft preferably takes into account that each panel serves alternately as the leeward and windward panel during use. The stretchability of the webs accommodates the change in shapes of the panels while supporting each panel relative to the other.

It is desirable to rig the sail 20 so that the luff edge of the panel can move rearwardly relative to luff edge of the windward panel. There are a number of ways of rigging sail 20 as is apparent to a person of ordinary skill in the art. For example, the luff edges of the panels may be provided with bolt ropes 42 and 44. Lashings 46 and 48 extending from the bolt ropes 42 and 44, respectively, may be looped through slides 50 which engage a track 52 on the mast.

FIGS. 5 and 6 illustrate two alternate ways of rigging a sail constructed according to the present invention. In FIG. 5, a jib sail constructed according to the principles of this is shown. The clews of each panel 26' and 28', are joined together and secured with a single line 54. Alternatively, as shown in FIG. 6, the clews of panels 26' and 28' could be secured with separate lines 56 and 58, if there is sufficient room and if local sailing rules permit.

When the boat is not headed windward, for example if the boat is on a dead run, no wind will pass between the panels. In this case the sail 20 will operate as a conventional sail.

OPERATION

The sail of this invention is raised on the rigging of the boat. When the sail is properly trimmed and the boat pointed windward, wind blows over the sail 20 and through sail 20 between panels 26 and 28 causing panels 26 and 28 to fill with air. The luff edge of the leeward sail advances relative to the luff edge of the windward sail. The webs 30 extending between the panels support the panels and help to maintain the shape of the panels. The webs 30 stretch to accommodate the shapes of the panels 26 and 28. The central portions 34 of the webs stretching transversely more than portions 32 and 36 to accommodate the greater distance between the central portion of the panels 32 and 36. This allows the panels to maintain substantially their designed shapes, thereby operating at maximum efficiency. The sail can be moved from one side of the boat to the other. The webs 30 flex sufficiently so that the panels can shift relative to each other as the sail moves from one side of the boat to the other.

In view of the above, it will be seen that the several objects of the invention are achieved and other advantageous results attained.

As various changes could be made in the above constructions without departing from the scope of the invention, it is intended that all matter contained in the above description or shown in the accompanying drawings shall be interpreted as illustrative and not in a limiting sense.

I claim:

1. A sail for a boat comprising:

a first panel having a predetermined draft therein;

a second panel having a predetermined draft therein; and a plurality of baffles extending between the first and second panels, the baffles comprising a plurality of elevationally spaced, generally horizontal webs extending substantially from the luff edges to the leech edges of the panels, the first and second panels being open at the luff and leech edges to allow wind to pass therebetween so that the first and second panels can assume their respective predetermined draft shapes.

2. The sail according to claim 1 wherein each web is cambered longitudinally in the luff to leach direction.

3. The sail according to claim 2 wherein the leech end of each web is elevationally higher than the luff end of the web.

4. A sail for a boat comprising:

a first panel having a predetermined draft therein;

a second panel having a predetermined draft therein; and a plurality of baffles extending between the first and second panels, the baffles comprising a plurality of elevationally spaced, generally horizontal webs of stretchable material extending substantially from the luff edges to the leech edges of the panels, each web comprising at least two portions having different transverse stretchability, the first and second panels being open at the luff and leech edges to allow wind to pass therebetween so that the first and second panels can assume their respective predetermined draft shapes.

5. The sail according to claim 4 wherein the portions of the webs between the panels at their maximum draft curvature have the maximum transverse stretchability.

6. The sail according to claim 4 wherein each web comprises a plurality of portions of different transverse stretchability, the portion between the points of maximum draft curvature of the panels having the greatest transverse stretchability, and the portions between the panels at the luff and leech edges having lesser transverse stretchabilty.

7. The sail according to claim 6 wherein each web is cambered longitudinally in the luff to leach direction.

8. The sail according to claim 7 wherein the leech end of each web is elevationally higher than the luff end of the web.

9. The sail according to claim 1 wherein the webs include a plurality of stiffeners.

10. The sail according to claim 1 wherein the webs are sufficiently flexible to permit the relative advancement of the luff edge of the leeward panel with respect to the luff edge of the windward panel.

11. A sail for a boat comprising:

a first panel having a predetermined draft therein;

a second panel having a predetermined draft therein; and a plurality of elevationally spaced generally horizontal webs connecting and spacing the panels, each web being cambered longitudinally in the luff to leech direction, the panels being open at their luff and leech edges to allow air to pass between the panels so that the first and second panels can fill with air, the webs being sized and shaped to space the first and second panels to maintaim their respective predetermined drafts.

12. The sail according to claim 11 wherein the leech end of each web is elevationally higher than the luff end of the web.

13. The sail according to claim 11 wherein the web comprises at least two portions of differing transverse stretchability.

14. The sail according to claim 13 wherein the portions of the webs between the panels at their maximum draft curvature have the maximum transverse stretchability.

15. The sail according to claim 11 wherein each web comprises a plurality of portions of different transverse stretchability, the portion between the points of maximum draft curvature of the panels having the greatest transverse stretchability, and the portions between the panels at the luff and leech edges having lesser transverse stretchability.

16. The said according to claim 15 wherein the leech end of each web is elevationally higher than the luff end of the web.

17. A sail for a boat comprising:

a first panel having a predetermined draft therein;

a second panel having a predetermined draft therein; and a plurality of generally horizontal webs extending substantially from the luff edges to the leech edges of the panels, the webs connecting and spacing the panels, the panels being open at their luff and leech edges to allow air to pass between the panels, the webs being sized and shaped to space the first and second panels to maintain their respective predetermined drafts when the luff edge of the leeward panel is advanced relative to the luff edge of the windward panel.

* * * * *